US007743832B2

(12) United States Patent
Shaw et al.

(10) Patent No.: US 7,743,832 B2
(45) Date of Patent: Jun. 29, 2010

(54) METHOD OF RUNNING A TUBING HANGER AND INTERNAL TREE CAP SIMULTANEOUSLY

(75) Inventors: Gary A. Shaw, Houston, TX (US); Robert S. Buchan, Aberdeen (GB); Kevin G. Buckle, By Ellon (GB)

(73) Assignee: Vetco Gray Inc., Houston, TX (US)

( * ) Notice: Subject to any disclaimer, the term of this patent is extended or adjusted under 35 U.S.C. 154(b) by 492 days.

(21) Appl. No.: 11/690,373

(22) Filed: Mar. 23, 2007

(65) Prior Publication Data

US 2008/0230229 A1 Sep. 25, 2008

(51) Int. Cl.
*E21B 29/12* (2006.01)

(52) U.S. Cl. ..... 166/338; 166/348; 166/368; 166/382; 166/89.3

(58) Field of Classification Search ..... 166/348, 166/338, 340, 345, 382, 89.3, 97.1
See application file for complete search history.

(56) References Cited

U.S. PATENT DOCUMENTS 3,693,714 A * 9/1972 Baugh ..... 166/348
3,847,215 A * 11/1974 Herd ..... 166/337
4,373,584 A * 2/1983 Silberman et al. ..... 166/117.7
4,691,780 A * 9/1987 Galle et al. ..... 166/348
4,736,799 A * 4/1988 Ahlstone ..... 166/348
4,903,776 A * 2/1990 Nobileau et al. ..... 166/382
5,372,201 A 12/1994 Milberger et al.
5,450,905 A * 9/1995 Brammer et al. ..... 166/348
5,544,707 A * 8/1996 Hopper et al. ..... 166/382
5,555,935 A * 9/1996 Brammer et al. ..... 166/88.1
5,575,336 A * 11/1996 Morgan ..... 166/330
5,868,204 A 2/1999 Pritchett et al.
5,884,706 A * 3/1999 Edwards ..... 166/335
5,971,077 A * 10/1999 Lilley ..... 166/368
5,988,282 A * 11/1999 Jennings et al. ..... 166/348
6,050,339 A 4/2000 Milberger
6,053,252 A * 4/2000 Edwards ..... 166/348
6,062,314 A * 5/2000 Nobileau ..... 166/368
6,076,605 A * 6/2000 Lilley et al. ..... 166/368
6,227,300 B1 * 5/2001 Cunningham et al. ..... 166/339
6,227,301 B1 * 5/2001 Edwards et al. ..... 166/344
6,253,854 B1 * 7/2001 Fenton ..... 166/364
6,367,551 B1 * 4/2002 Fenton ..... 166/345
6,378,613 B1 * 4/2002 Kent et al. ..... 166/368
6,470,968 B1 * 10/2002 Turner ..... 166/348
6,494,257 B2 * 12/2002 Bartlett et al. ..... 166/86.2

(Continued)

FOREIGN PATENT DOCUMENTS

GB 2320513 A 6/1998

(Continued)

*Primary Examiner*—Thomas A Beach
(74) *Attorney, Agent, or Firm*—Bracewell & Giuliani

(57) ABSTRACT

During the completion of a subsea horizontal tree, a tubing hanger and internal tree cap are run together with the same running tool and running string. The running tool has a linking assembly that connects the tree cap to the tubing hanger during running, retrieval, or workover, so that the tree cap supports the weight of the tubing hanger and string of tubing. The linking assembly can be retrieved with the running tool or retrieved on wireline through the running string.

19 Claims, 10 Drawing Sheets

U.S. PATENT DOCUMENTS 6,520,263 B2 * 2/2003 June ..... 166/368
6,581,691 B1 * 6/2003 Jennings et al. ..... 166/348
6,612,368 B2 * 9/2003 Kent et al. ..... 166/75.13
6,675,900 B2 * 1/2004 Baskett et al. ..... 166/379
6,810,954 B2 * 11/2004 Garrett et al. ..... 166/77.51
7,063,157 B2 * 6/2006 Bartlett ..... 166/339
7,350,583 B2 * 4/2008 Nguyen et al. ..... 166/379

FOREIGN PATENT DOCUMENTS

GB 2347703 A 9/2000
GB 2377954 A 1/2003

* cited by examiner

METHOD OF RUNNING A TUBING HANGER AND INTERNAL TREE CAP SIMULTANEOUSLY

FIELD OF THE INVENTION

This invention relates in general to subsea wellhead equipment, and in particular to a method of simultaneously running an internal tree cap and tubing hanger into a subsea horizontal tree.

BACKGROUND OF THE INVENTION

A conventional subsea horizontal tree includes a wellhead housing which contains one or more casing hangers, one of which is secured to a string of production casing that extends into the well. A horizontal tree body, also known as a tree or tubing spool or spool tree, mounts to the top of the wellhead housing and seals to it. The horizontal tree body has a central bore axially through it and a horizontal or lateral production flow passage through the wall of the horizontal tree body. A tubing hanger lands and seals in the central bore of the horizontal tree body and is secured to a string of tubing that extends through the production casing hanger and production casing into the well. The tubing hanger has a production bore axially through it that is in fluid communication with the tubing. The tubing hanger also has a lateral flow passage in fluid communication with the tubing hanger production bore and with the lateral production flow passage in the horizontal tree body.

Annular seals are located between the tubing hanger and the central bore of the horizontal tree body above the production flow passage to provide primary, and occasionally, secondary barriers to leakage from the production flow pathways and well bore. Additionally, one or more wireline deployable plugs fit in one or more lockdown profiles in the tubing hanger production bore to provide primary, and occasionally, secondary barriers to leakage from the production and well bores. A tree cap may also fit above the tubing hanger in the central bore of the horizontal tree body. The tree cap may be of an internal or external lockdown configuration. In either case, the tree cap will seal to the central bore of the horizontal tree body and act as an additional barrier to leakage from the well. The tree cap of either configuration may have a vertical bore through it.

Another typical feature of subsea horizontal trees is an annulus and workover passageway that establishes a fluid communication pathway between the annular space around the tubing below the tubing hanger and a space inside the central bore of the horizontal tree body above the tubing hanger. This annulus and workover passageway can be ported through the tubing hanger, through the horizontal tree body or a combination of both. Alternatively, the annulus and workover passageway may be ported entirely out of the tree from a position below the tubing hanger.

In practice, there are generally two horizontal tree configurations: (1) a horizontal tree with a tubing hanger fitted with one or more plugs in its production bore and an internal tree cap, with a plug in its vertical bore; or (2) a horizontal tree with a tubing hanger fitted with at least two plugs in its production bore and eliminating the internal tree cap. This second style of horizontal tree typically utilizes a tree cap that locks externally to the tree body and may or may not include a seal to the tree body. In either tree cap case, the annulus and workover passageway will contain at least two closure members in the form of gate valves, for example.

The primary difference between these two general horizontal tree configurations is that the first has a primary and secondary barrier that employs independent lockdown structures for the two barriers, and the second has a primary and secondary barrier that ultimately rely on the tubing hanger to horizontal tree body lockdown structure. Some operators, and some regulatory authorities believe that the first and second horizontal tree configurations are equivalently safe in operation. Other operators and regulatory authorities believe only the first configuration meets the dual barrier industry philosophies and/or regulatory requirements.

One advantage of the second configuration is that the elimination of the internal tree cap eliminates the need for a second drill pipe run to install it. In running (or working over) the first style of horizontal tree, the tubing hanger is run into the horizontal tree body typically on a hydraulically-actuated running tool that is run on drill pipe. Afterwards, the internal tree cap is run into the horizontal tree body typically on the same hydraulically-actuated running tool, or one very similar, on drill pipe. This results in two drill pipe trips to the seafloor.

In running (or working over) the second style of horizontal tree, the tubing hanger is run into the horizontal tree body typically on the hydraulically-actuated running tool on drill pipe. Afterwards, a lower plug is run on wireline and landed, locked and sealed to the production bore of the tubing hanger and then an upper plug is run on wireline and landed, locked and sealed to the production bore above the first plug. In deeper water wells, this results in potentially significant rig time savings. However, it comes with the compromise that the two plugs rely on the single tubing hanger lockdown mechanism to ensure that the tubing string assembly does not part from the tree and cause potentially significant leakage of the well bore to the environment.

SUMMARY

In this invention, a new method for completing a subsea well is provided, which involves the simultaneous running of the tubing hanger and internal tree cap. This method provides substantially similar equipment running, retrieving and workover times for the horizontal tree configured for both a tubing hanger and an internal tree cap as is provided with the horizontal tree configured for a tubing hanger with multiple plugs and no separately locked and sealed internal tree cap. Thus, it provides the advantage of a horizontal tree with two separate pressure barriers carried on two separate structures with independent lockdown mechanisms, without the cost of significant operational time during installation and retrieval.

More particularly, the method comprises connecting a running tool to the internal tree cap and to the tubing hanger, then lowering the internal tree cap, tubing hanger and string of tubing as an assembly. After landing the running tool locks the tubing hanger and the internal tree cap to the bore of the tree.

Preferably the internal tree cap and the tubing hanger each have a radially movable locking element and an axially movable actuator. In some of the embodiments, the running is lowered after the tubing hanger lands, which causes the tree cap to stroke the actuator of the tubing hanger to cause the locking element of the tubing hanger to move radially into a profile formed in the bore of the tree. Then, the running tool strokes the actuator of the internal tree cap to cause the locking element of the internal tree cap to move radially into a profile formed in the bore of the tree. In other embodiments, a piston is incorporated within the internal tree cap to push the tubing hanger actuator downward after the tubing hanger lands.

Preferably, the running tool has a lifting member that connects to the internal tree cap and a linking assembly that connects between the internal tree cap and the tubing hanger. While running the assembly down to the subsea tree, the internal tree cap supports the weight of the tubing hanger and string of tubing through the linking assembly. After the tubing hanger is set, the linking assembly is retrieved. Preferably, the linking assembly is retrieved by a wireline tool lowered through the running string and running tool.

DETAILED DESCRIPTION OF THE INVENTION

Figure 1:
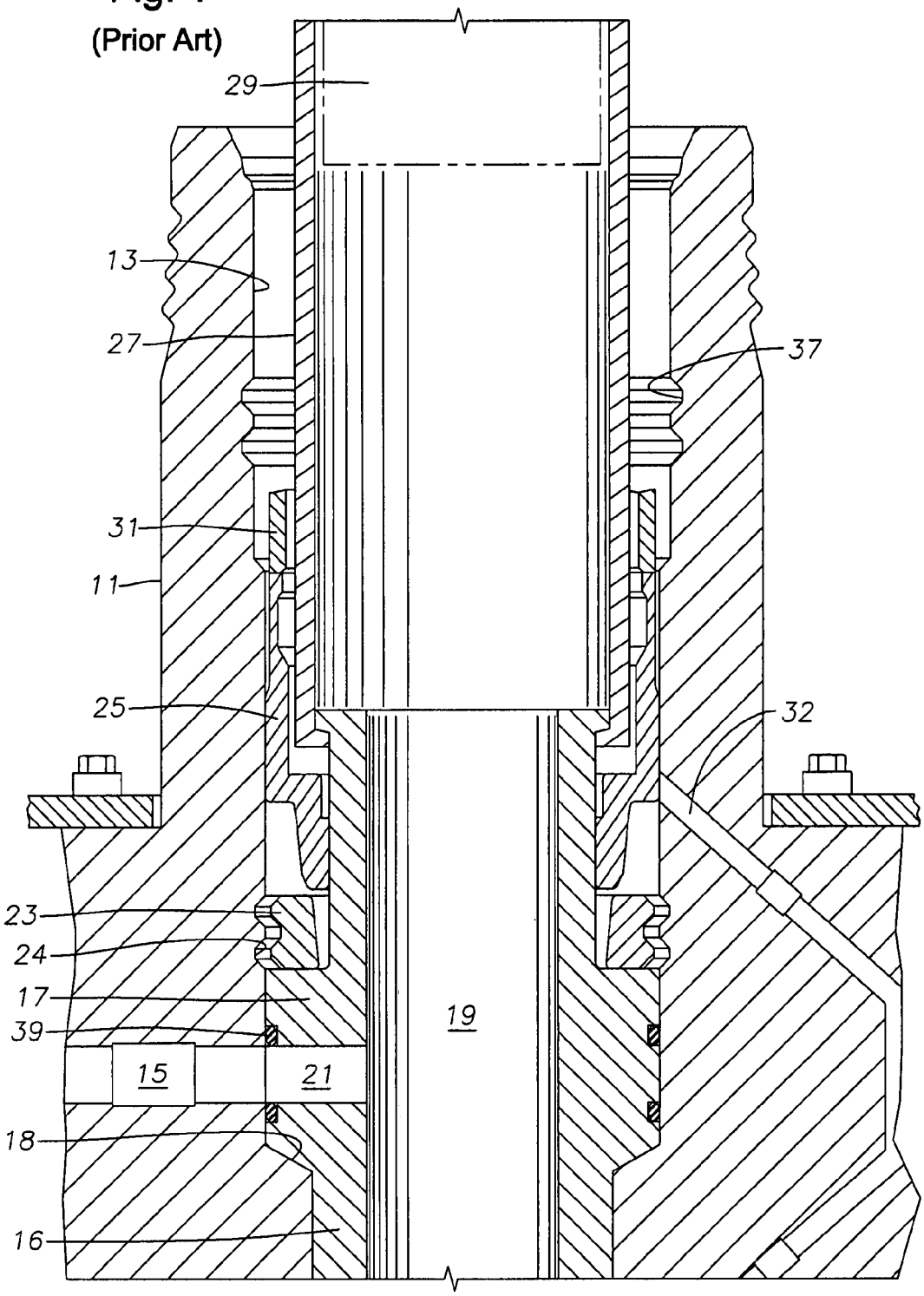
Fig. 1 (Prior Art)
FIG. 1 is a schematic sectional view of a tubing hanger being installed in a subsea tree by a running tool in a prior art method.

Referring to FIG. 1, a subsea production tree 11 is schematically illustrated. Tree 11 has an axially extending bore 13 and a laterally extending production passage 15. A tubing hanger 17 is secured to a string of tubing 16 and lands on a shoulder 18 in bore 13. Tubing hanger 17 has an axial passage 19 and a lateral production outlet 21 that registers with tree passage 15. Tubing hanger 17 is locked to tree bore 13 by a locking element 23 that comprises a radially expansible split ring for engaging an annular profile 24 in tree bore 13. Locking element 23 is moved radially outward in response to downward movement of an actuator sleeve 25, which is part of the tubing hanger assembly.

Tubing hanger 17 is installed by a running tool 29 that has a lifting member 27 that engages a profile on the upper end of the body of tubing hanger 17. Running tool 29 has an actuating sleeve 31 that when actuated will stroke actuator 25. After setting, as shown in FIG. 1, running tool 29 releases its lift member 27 from tubing hanger 17 and is retrieved.

Tree 11 typically has a tubing annulus bypass passage 32 that extends from tree bore 13 below tubing hanger 17 to above tubing hanger 17. Tubing annulus bypass 32 allows circulation between the annulus surrounding the tubing and the interior of the tubing.

Figure 2:
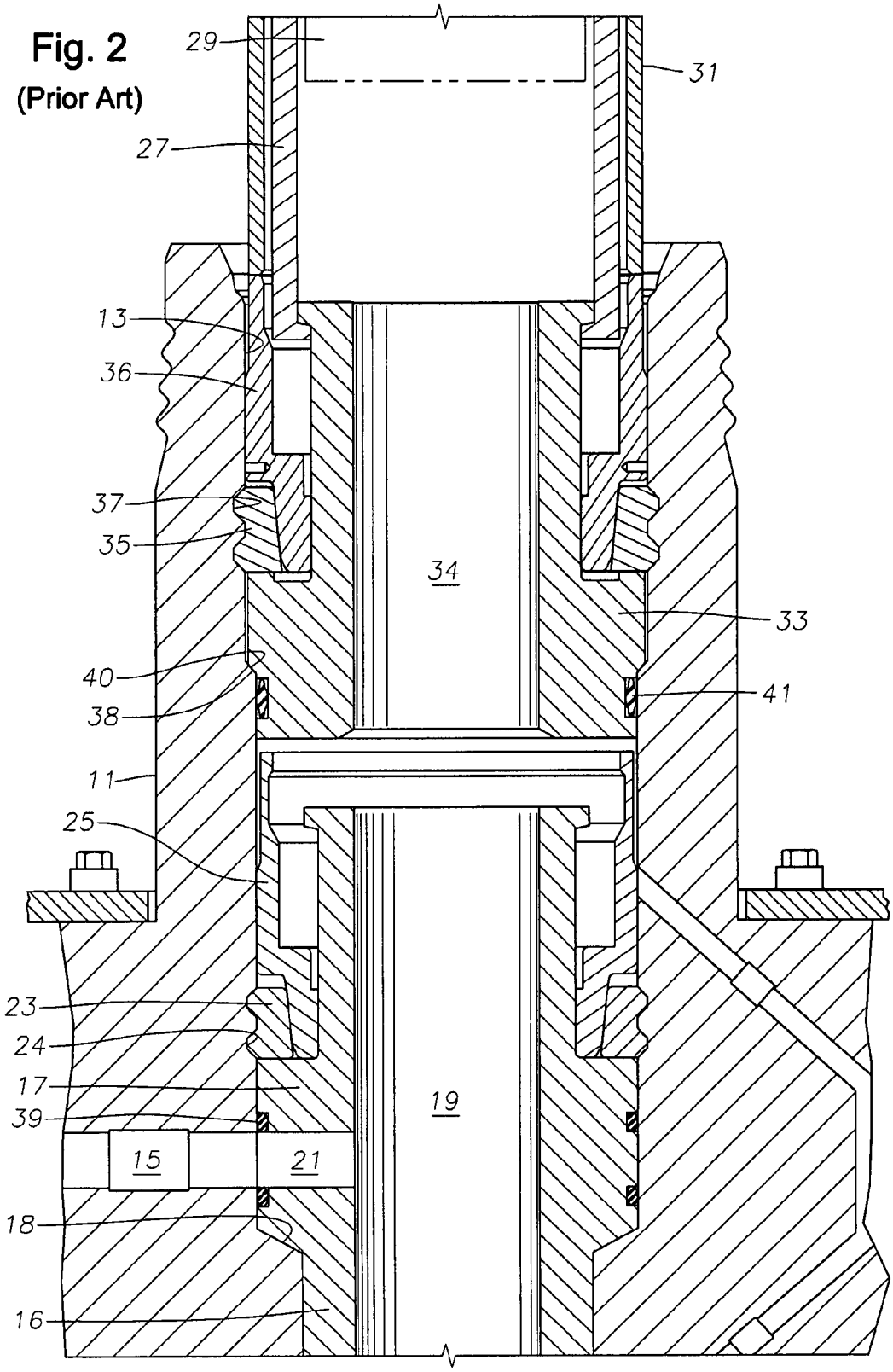
Fig. 2 (Prior Art)
FIG. 2 is a schematic sectional view of an internal tree cap being installed in the subsea tree by the running tool of FIG. 1 in a prior art method.

Referring to FIG. 2, after tubing hanger 17 has been set and the well tested, the operator lowers an internal tree cap 33 into bore 13 and lands its external landing shoulder 38 on a landing shoulder 40 in tree bore 13. Tree cap 33 has an axially passage 34 that registers with tubing hanger passage 19. Tree cap 33 has an expansible locking member 35 that engages an upper profile 37 in tree bore 13. Tree cap 33 has an actuator 36 that when stroked downward will move locking member 35 radially outward. Tree cap 33 is typically installed with the same running tool 29. Actuator sleeve 31 of running tool 29 forces tree cap actuator 36 downward to the locked position. Running tool lift member 27 engages a profile on upper portion of tree cap 33 in the same manner as with tubing hanger 17. After installation of tree cap 33, running tool 29 is retrieved. A first annular seal 39 seals between the tubing hanger 17 and the bore 13. A second annular seal 41 seals between tree cap 33 and bore 13.

Figure 3:
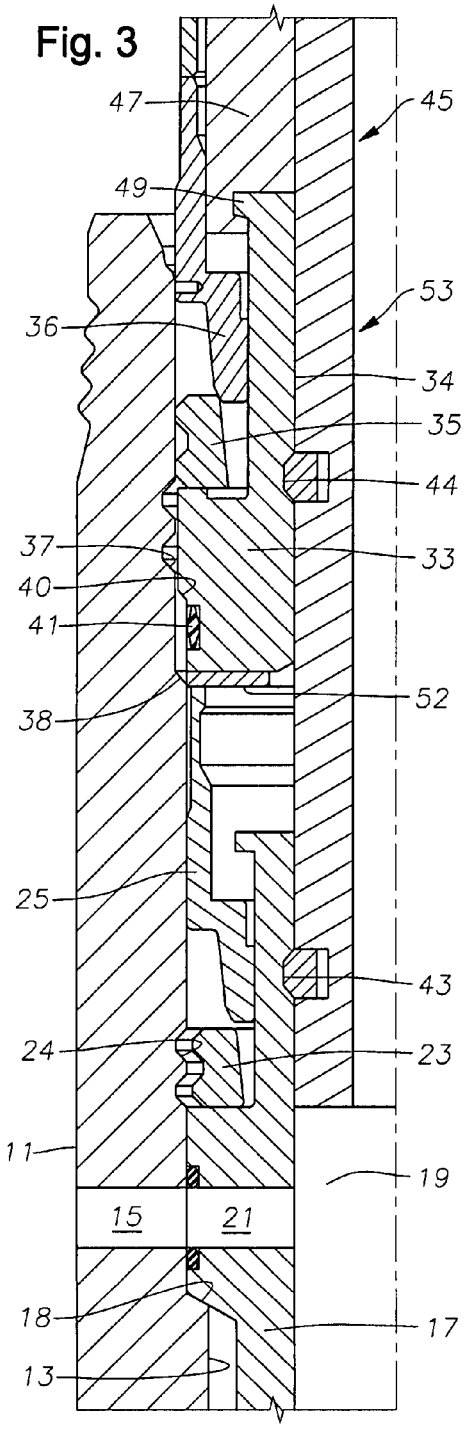
FIG. 3 is a schematic sectional view of the tubing hanger of FIG. 1 and internal tree cap of FIG. 2 being installed simultaneously in a subsea tree in accordance with a method of this invention, and showing the tubing hanger landed but not yet locked to the tree.

Referring to FIG. 3, in this example, tubing hanger 17 may be the same as prior art tubing hanger 17, except that it has an annular internal profile 43 formed in its vertical passage 19 above lateral passage 21. Similarly, internal tree cap 33 may be the same as the prior art internal tree cap 33, except that in this example it has an annular internal profile 44 formed in its vertical passage 34. Running tool 45 is similar to prior art running tool 29 in that it has a lifting member 47 that engages a profile or flange 49 on an upper portion of internal tree cap 33. Running tool 45 also has an actuator sleeve 51 that strokes tree cap actuator 36 downward.

In the method of this invention, running tool 45 runs tree cap 33 and tubing hanger 17 in the same trip. Running tool 45 has a linking assembly 53 that links internal tree cap 33 to tubing hanger 17 so that tree cap 33 will support the weight of tubing hanger 17 and the string of tubing. A spacer plate 52 is secured to the bottom of tubing hanger 33. Spacer plate 52 is movable from the outer position shown in FIG. 3 to the inner position shown in FIG. 5. A spring (not shown) may be incorporated with spacer plate 52 to cause the movement.

Figure 4:
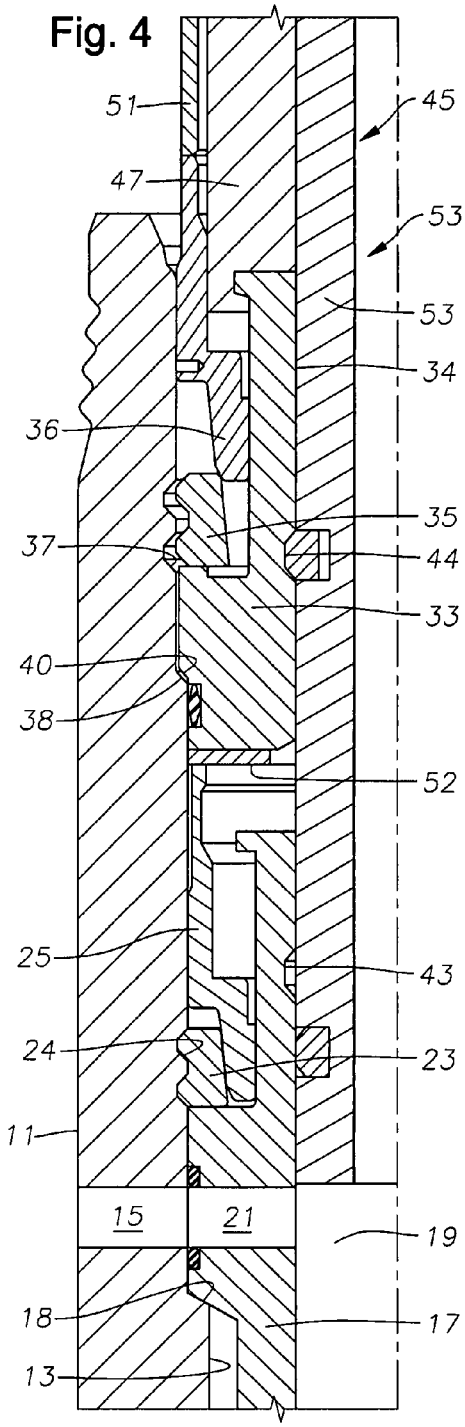
FIG. 4 is another schematic sectional view illustrating the method of FIG. 3 and showing the tubing hanger locked to the tree.
Figure 5:
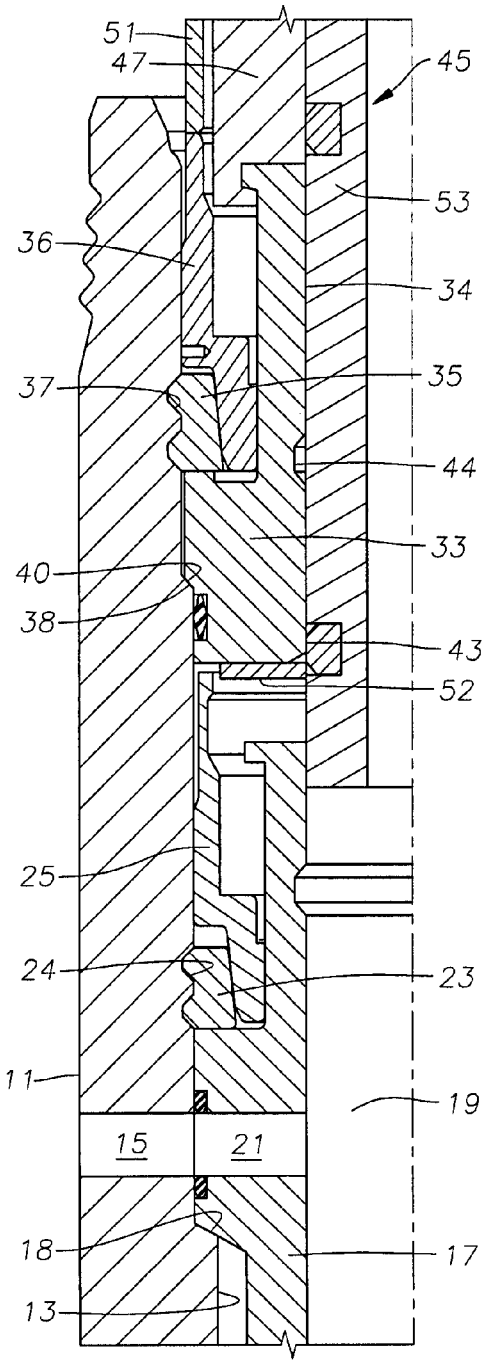
FIG. 5 is another schematic sectional view illustrating the method of FIG. 3 and showing the internal tree cap locked to the tree.

In the operation of the embodiment of FIGS. 3-5, the operator assembles a string of tubing and connects the string to tubing hanger 17. The operator inserts linking assembly 53 into tree cap passage 34 and tubing hanger passage 19 and causes linking assembly 53 to engage profiles 43 and 44. The operator extends running tool lifting member 47 into engagement with flange 49 of tree cap 33. Spacer plate 52 is located between the upper end of tubing hanger actuator 25 and the lower end of tree cap 33.

The operator runs running tool 45 on a string of conduit, such as drill pipe. The entire assembly comprising the string of tubing, tubing hanger 17, tree cap 33, and running tool 45 are lowered simultaneously. In this example, when tubing hanger 17 lands on landing shoulder 18, the operator continues to lower the running string a short distance. The weight of the running string transfers through running tool 45, to the tree cap 33, and from there through spacer plate 52 to tubing hanger actuator 25. This weight causes actuator 25 to move to the lower position, forcing tubing hanger locking member 23 into locking profile 24 as shown in FIG. 4.

When tubing hanger actuator 25 is in its lowest position, tree cap shoulder 38 will be spaced a short distance above its landing shoulder 40, as shown in FIG. 4. Before setting tree cap actuator 36, tree cap 33 must be lowered a short distance further so that its locking member 35 aligns with upper profile 37. This relative movement between tree cap 33 and tubing hanger 17 could occur by retrieving linking assembly 53 or releasing the engagement of linking assembly with either tubing hanger internal profile 43 or tree cap internal profile 44. In this particular embodiment, after setting tubing hanger 17 as shown in FIG. 4, the operator causes running tool 45 to disengage from profile 43 in tubing hanger 17 and spacer plate 52 to retract. The operator lowers the running string and running tool 45 along with tree cap 33 a short distance to land shoulder 38 on shoulder 40, which aligns locking element 35 with upper profile 37. The operator then strokes actuating sleeve 51 of running tool 45 downward to force tree cap actuator 36 to the lower position as shown in FIG. 5. Actuator 36 forces locking member 35 outward into tree bore profile 37. The operator then releases linking assembly 53 from tree cap profile 44 and retrieves linking assembly 53 and running tool 45.

Figure 6:
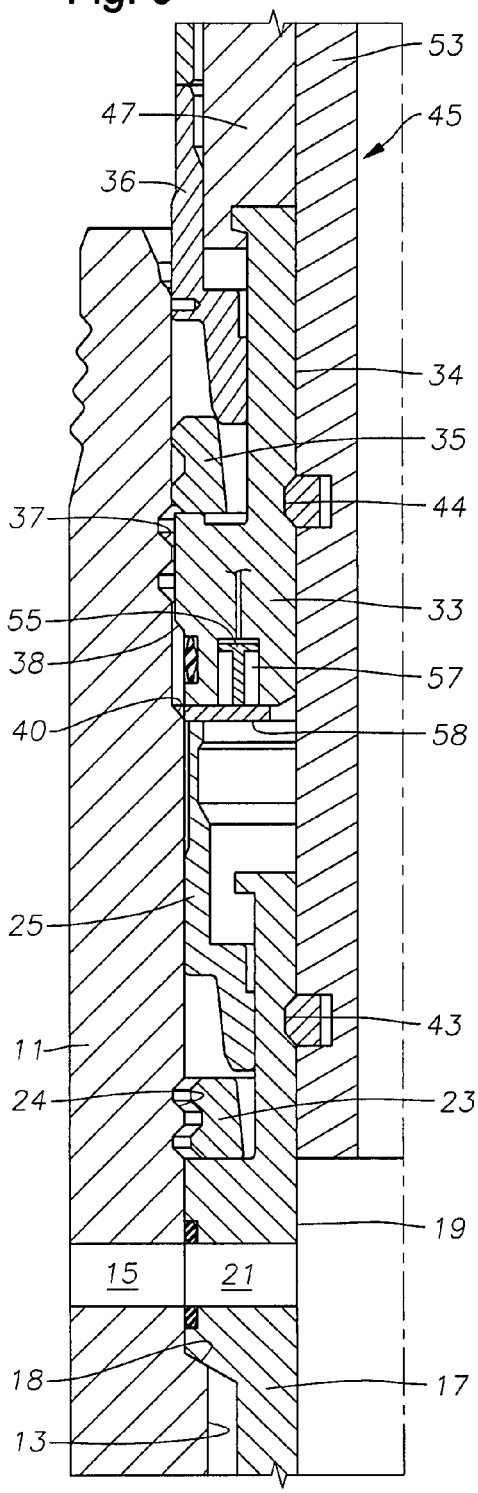
FIG. 6 is a schematic sectional view illustrating another method of simultaneously installing a tubing hanger and an internal tree cap.

In the embodiment just described, tubing hanger actuator 25 is set by the weight of the running string acting through tree cap 33. In the embodiment of FIG. 6, a piston 55 is mounted within a chamber 57 in a lower portion of internal tree cap 33. Chamber 57 that is supplied with hydraulic fluid pressure from running tool 45, which is controlled by an umbilical line leading to the vessel on the surface. A load transfer plate 58 is carried on the end of piston 55 for contact with tubing hanger actuator 25. Load transfer plate 58 is laterally movable, such as by a spring, from the outer position shown to an inner position radially inward from tubing hanger actuating 25.

After tubing hanger 17 has landed on shoulder 18, initially tree cap shoulder 38 will be spaced a short distance above its landing shoulder 40. The operator signals running tool 45 to supply hydraulic fluid pressure to piston chamber 57. Piston 55 then pushes tubing hanger actuator 25 downward via load transfer plate 58 to cause locking element 23 to engage locking profile 24. The operator retracts piston 55 and allows load transfer plate 58 to shift inward from tubing hanger actuator 58.

It will be necessary to lower tree cap 33 downward a short distance so that it will land on its landing shoulder 40 before stroking tree cap actuator 36. One way to accomplish this movement is to retrieve linkage assembly 53, then lower tree cap 33 on the running tool 45. Alternately, the linkage assembly 53 could disengage from either tubing hanger internal profile 43 or tree cap internal profile 44, or both. Once, tree cap shoulder 38 has landed on shoulder 40, the operator uses running tool 45 to stroke tree cap actuator 36 to the locked position. The operator then releases running tool lifting member 47 from tree cap 33 and retrieves running tool 45.

Note that in both the embodiments of FIGS. 3-5 and 6, the linking assembly 53 is illustrated as being retrieved with running tool 45. However, as will be subsequently explained, linking assembly 53 could be a separate component of running tool 45 such that it is retrieved before retrieving running tool 45. In that instance, linking assembly 53 could be retrieved by running a wireline tool through the running string and running tool and engaging linking assembly 53 to retrieve it.

Figure 8:
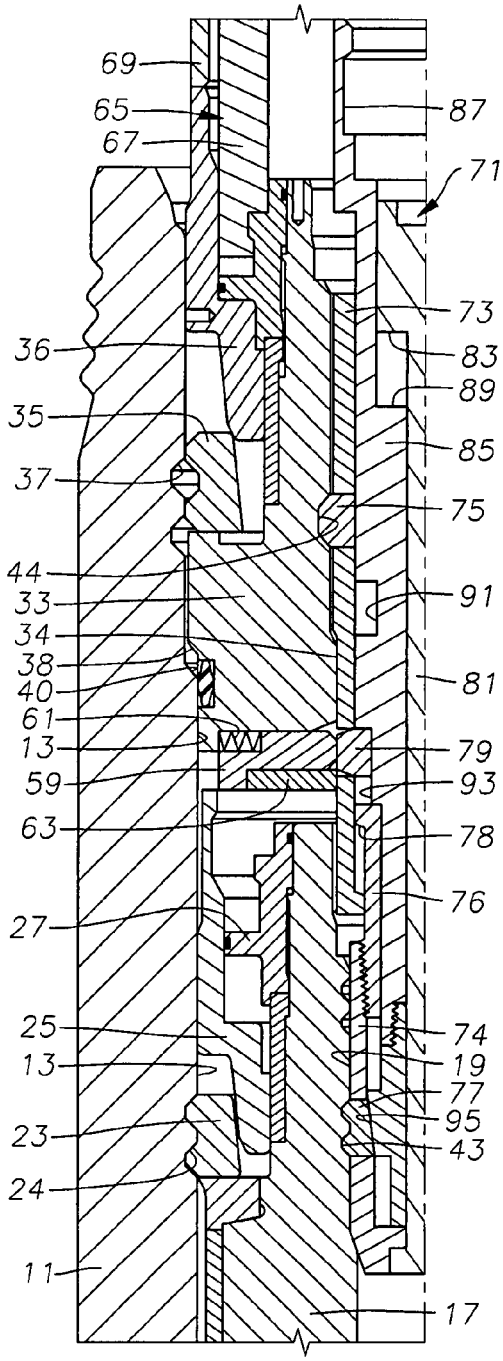
FIG. 8 is another sectional view of the method of FIG. 7 and showing the tubing hanger locked to the tree.
Figure 9:
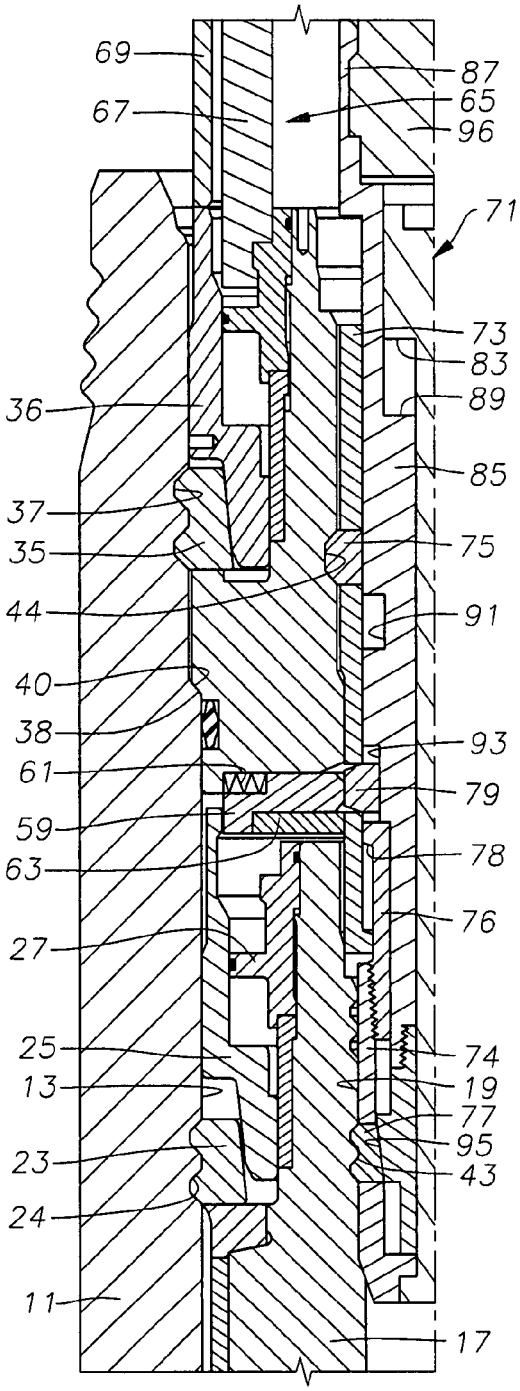
FIG. 9 is another sectional view of the method of FIG. 7 and showing the internal tree cap locked to the tree.
Figure 10:
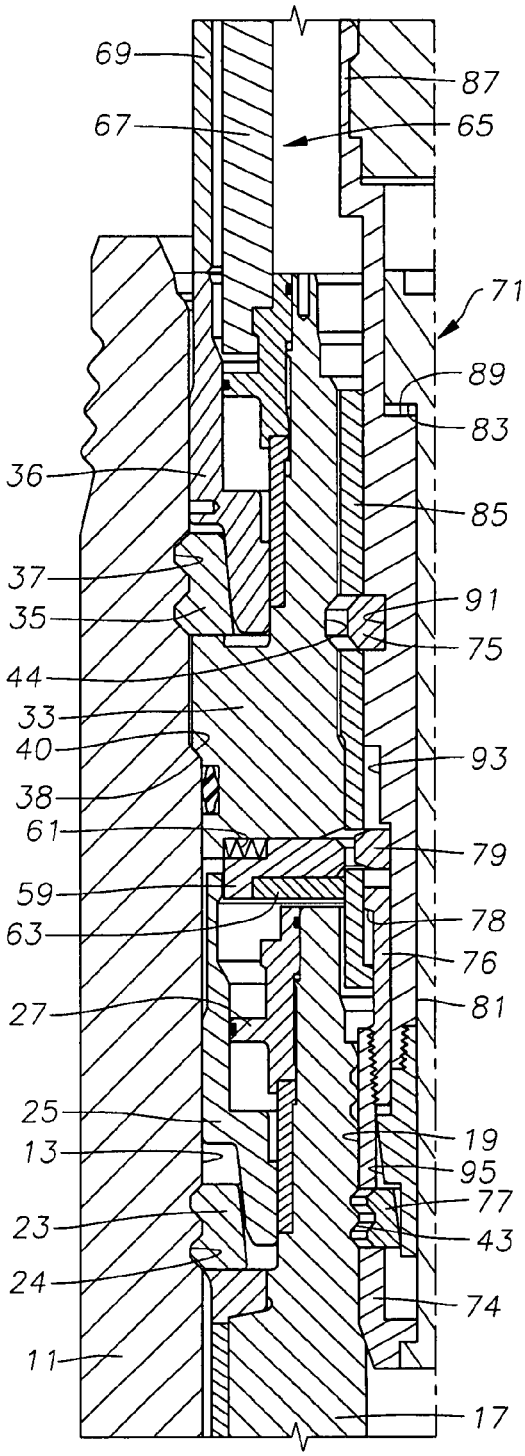
FIG. 10 is another sectional view of the method of FIG. 7 and showing a linking assembly of the running tool released from the tubing hanger and the internal tree cap for retrieval.

FIGS. 7-10 illustrate another embodiment. In this embodiment, a spacer 59 is positioned between the upper end of tubing hanger actuator 25 and the lower end of internal tree cap 33. Spacer 59 is preferably radially movable and may comprise a plurality of separate segments spaced around the axis of internal tree cap 33. Spacer 59 is biased radially inward by a spring 61. Spacer 59 is retained on the lower end of tree cap 33 by a retainer plate 63. When spacer 59 is moved to the inner position as shown in FIG. 10, it will be located radially inward of the upper end of tubing hanger actuator 25.

Running tool 65, as in the other embodiments, has a lifting member 67 that will engage a profile on an upper portion of tree cap 33. Running tool 65 has a hydraulically actuated actuator 69 (FIG. 8) that when stroked downward will force tree cap actuator 36 downward. Running tool 65 has a linking assembly 71, which in this embodiment, is separately retrieved from the remaining portion of running tool 65. Linking assembly 71 has an upper linking sleeve 73 that locates within passage 34 of tree cap 33. Upper linking sleeve 73 supports a set of upper dogs 75 located in windows for engaging internal profile 44 in tree cap 33. Dogs 75 are radially moveable between the outer position of FIG. 7 and the inner position of FIG. 10. Upper linking sleeve 73 is connected by a slip joint sleeve 76 to a lower linking sleeve 74. Lower linking sleeve 74 is located in tubing hanger passage 19 and supports a set of lower dogs 77 located in windows for engaging internal profile 43. Lower dogs 77 are moveable between the outer position in FIG. 7 and the inner position in FIG. 10.

Slip joint sleeve 76 is rigidly secured by threads to lower linking sleeve 74. Upper linking sleeve 73 has an internal flange that engages an external flange 78 on slip joint sleeve 76 to transmit tension. When tubing hanger 17 has landed, upper linking sleeve 73 is downwardly moveable relative to slip joint sleeve 76, as shown by comparing FIG. 7 to FIGS. 8-10. A set of intermediate dogs 79 are located in windows in upper linking sleeve 73 for engagement with spacer 59. Dogs 79 prevent spacer 59 from moving to the inner position while dogs 79 are located in their outer position.

A stem 81 is located within the inner diameters of linking sleeve 73, lower linking sleeve 74 and slip joint sleeve 76. Stem 81 is rigidly secured at its lower end to the lower end of lower linking sleeve 74 for movement therewith. Stem 81 defines an annular space between its exterior and the interior of linking sleeves 73 and 74. Stem 81 may be solid or hollow. Stem 81 has a downward facing shoulder 83 on its exterior.

A backup sleeve 85 is reciprocally carried within the annular space between linking sleeves 73, 74 and stem 81. Backup sleeve 85 has a retrieval profile 87 on its upper end and an upward facing shoulder 89 spaced below stem shoulder 83. Backup sleeve 85 has an upper recess 91 that is dimensioned to receive upper dog 75 when backup sleeve 85 is pulled upward to the position of FIG. 10. Backup sleeve 85 has an intermediate recess 93 that is spaced below intermediate dogs 79 in the operational position of FIG. 7 and which aligns with intermediate dogs 79 after tubing hanger 17 is set, as shown in FIG. 8. Backup sleeve 85 has a cam surface 95 on its lower end that pushes lower dogs 77 outward while stem 85 is in the lower position of FIG. 7.

Figure 7:
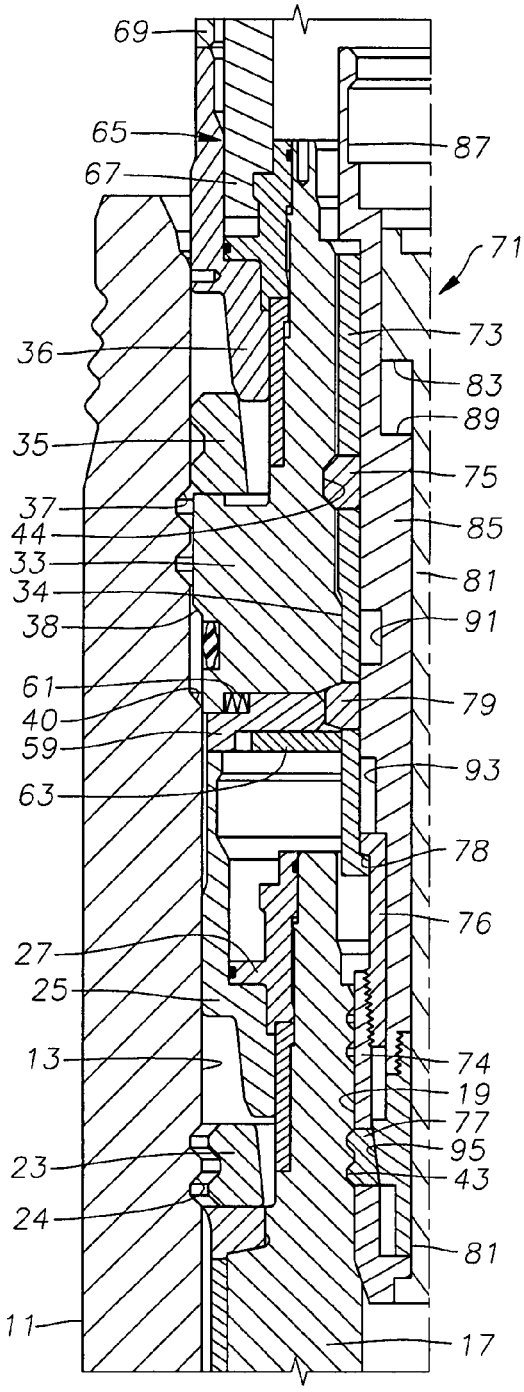
FIG. 7 is a sectional view illustrating another method of simultaneously installing a tubing hanger and an internal tree cap in a subsea tree, showing the tubing hanger landed but not yet locked to the tree.

In the operation of the embodiments of FIGS. 7-10, linking assembly 71 is inserted into tubing hanger 17 and tree cap 33 as shown in FIG. 7. Initially, recess 91 will align with upper dogs 75, intermediate recess 93 will align with intermediate dogs 79, and lower cam surface 95 will be spaced above lower dogs 77. When upper dogs 75 are aligned with internal profile 44, the operator lowers backup sleeve 85 relative to upper linking sleeve 73, which causes dogs 75 to be pushed outward to be in engagement with upper profile 44. At the same time, intermediate dogs 79 will be pressed outward, causing spacer 59 to move outward. Also, cam surface 95 will force dogs 77 outward. This is the position shown in FIG. 7.

The operator then lowers the entire assembly on a running conduit until tubing hanger 17 lands on its landing shoulder in the tree 11. At this point landing shoulder 38 on internal tree cap 33 will be spaced above its landing shoulder 40 in tree bore 13. The operator in this embodiment continues to lower the running string, which causes the weight to transfer to tree cap 33, through spacer 59 and to tubing hanger actuator 25. Tubing actuator 25 moves downward to sets tubing hanger locking element 23 as shown in FIG. 8.

When tubing hanger actuator 25 is fully set, tree cap shoulder 38 will be spaced a short distance above landing shoulder 40, as shown in FIG. 8. As tree cap 33 moved downward, it also caused intermediate dogs 79 to reach recess 93 and move inward, causing spacer 59 to move inward from the position of FIG. 8 to the position of FIG. 9. The retraction of spacer 59 allows tree cap 33 move further downward a short distance after tubing hanger actuator 25 is fully set in order to land tree cap shoulder 38 on bore shoulder 40, as shown in FIG. 9. Tree cap locking member 35 will now be aligned with tree bore upper profile 37. The operator then causes running tool 65 to stroke actuator sleeve 69 downward to set tree cap actuator 36, as shown in FIG. 9.

The operator then runs a wireline tool 96 through the running string and running tool 65 into latching engagement with retrieval profile 87 on backup sleeve 85. The operator pulls upward on the wireline to move backup sleeve 85 upward relative to linking sleeves 73, 74 and stem 81. When backup sleeve 85 reaches its upper position shown in FIG. 10, upper dogs 75 and lower dogs 77 move to the inner positions, releasing tubing hanger 17 and tree cap 33 from linkage assembly 71. The operator continues pulling on the wireline, which transfers the upward pull from backup sleeve shoulder 89 to stem shoulder 83, causing the entire linking assembly 71 to be retrieved up through the running tool 65 and running string. The running tool 65 may then be retrieved by releasing its lifting member 67 and retrieving the running string.

In the embodiment of FIGS. 11-16, a piston 97 is installed in internal tree cap 33 in a similar manner to the embodiment illustrated in FIG. 6. Piston 97 is biased upward by a spring 99. When hydraulic pressure is applied, piston 97 will move to the lower position of FIG. 13. Piston 97 has a transfer plate 101 carried on its lower end for lateral sliding movement. Transfer plate 101 has an inner position shown in FIG. 11 and an outer position shown in FIG. 12. In the inner position, transfer plate 101 is spaced radially inward from the tubing hanger actuator 25. In the outer position, transfer plate 101 is located above actuator 25 to transfer the downward force from piston 97 to actuator 25.

Linking assembly 103 has a linking sleeve 105 that extends completely through tree cap passage 34 and into tubing hanger passage 19. Linking sleeve 105 carries a set of upper dogs 107 that engage tree cap internal profile 44. Linking sleeve 105 carries a set of lower dogs 109 that engage tubing hanger internal profile 43. A stem 111 with a retrieval profile 113 on its upper end inserts within the inner diameter of linking sleeve 105. Stem 111 has a set of wickers or grooves 114 that engage in a ratcheting arrangement with internal wickers 115 at the upper end of linking sleeve 105. When wickers 114, 115 are engaged, step 11 is retained in the lower position of FIG. 12. An upward force on stem 111 of sufficient magnitude will cause wickers 114, 115 to disengage.

An expansion ring 117 is carried on an outer diameter portion of stem 111 radially inward from transfer plate 101. Expansion ring 117 has an inner position in engagement with a mating profile 119 on stem 111. When stem 111 is moved downward relative to expansion ring 117, expansion ring 117 will expand, pushing transfer plate 101 to its outer position, shown in FIG. 12.

Figure 11:
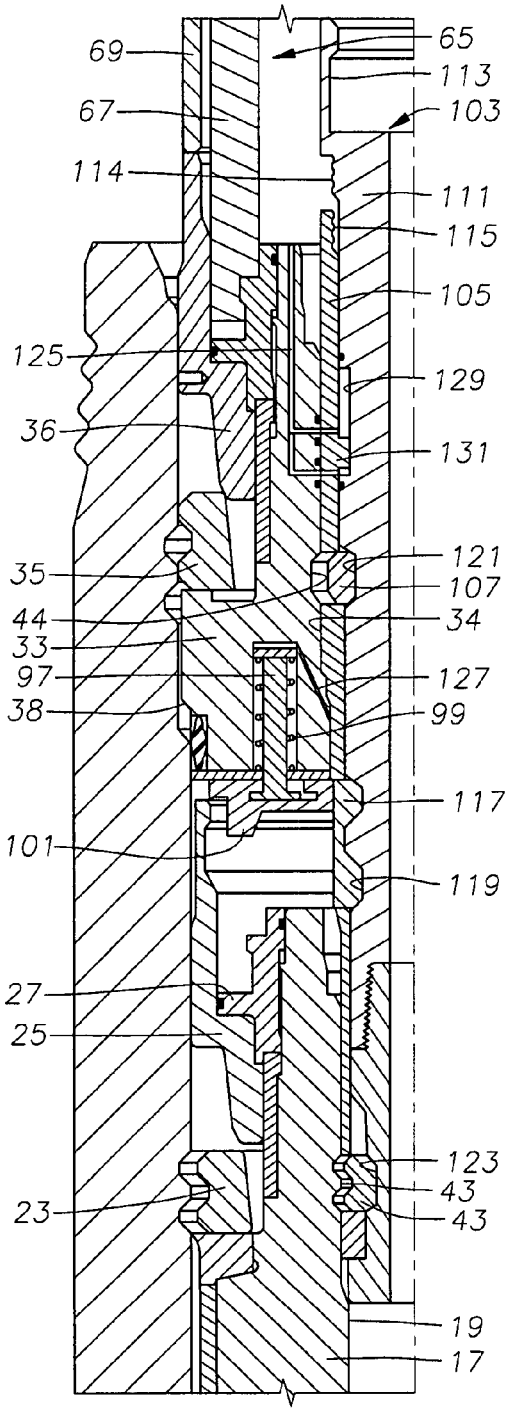
FIG. 11 is a sectional view illustrating another method of simultaneously installing a tubing hanger and an internal tree cap in a subsea tree and showing the a linking member of a running tool being connected to a tubing hanger and internal tree cap.

Stem 111 has an annular upper dog recess 121 that receives upper dogs 107 to place upper dogs 107 in the inner position when stem 11 is in the upper position shown in FIG. 11. Moving stem 111 downward pushes upper dogs 107 to the outer position shown in FIG. 12. Similarly, stem 111 has a lower dog recess 123 that aligns with lower dogs 109 to place lower dogs 109 are in the inner position when stem 111 is in the upper position of FIG. 11. Moving stem 111 downward pushes lower dogs 109 to the outer position of FIG. 12.

Referring still to FIG. 11, a plurality of hydraulic ports 125 (only one shown) are connected to running tool 65 to receive hydraulic fluid pressure for various functions. Alternately, a single port 125 could be employed with sequential valves to perform the various functions. One of the ports 125 supplies hydraulic fluid pressure to piston 97 via passage 127. Another port 125 supplies hydraulic fluid pressure to move stem 111 from the upper position of :FIG. 11 to the lower position of FIG. 12 and vice-versa. These functions are handled by providing stem 111 with an annular chamber 129 on its exterior that mates with a piston 131 mounted or formed on linking sleeve 105. Supplying pressure to chamber 129 below piston 131 causes stem 111 to move to the lower position of FIG. 12. Supplying pressure to chamber 129 above piston 131 causes stem 111 to move to the upper position of FIG. 11.

In the operation of the embodiment of FIGS. 11-16, while in the upper position, stem 111 is inserted along with linking sleeve 105 into tree cap passage 34 and tubing hanger passage 19, as shown in FIG. 11. Running tool 65 is attached to tree cap 33, with actuator sleeve 69 in engagement with tree cap actuator and hydraulic stabs in engagement with ports 125. The operator supplies hydraulic fluid pressure to the lower side of piston 131 to cause stem 111 to move downward from the assembly position of FIG. 11 to the installed position of FIG. 12. Wickers 114, 115 will ratchet into engagement with each other and dogs 107 and 109 will engage the respective internal profiles 44 and 43. Expansion ring 117 pushes transfer plate 101 to the outer position.

Figure 12:
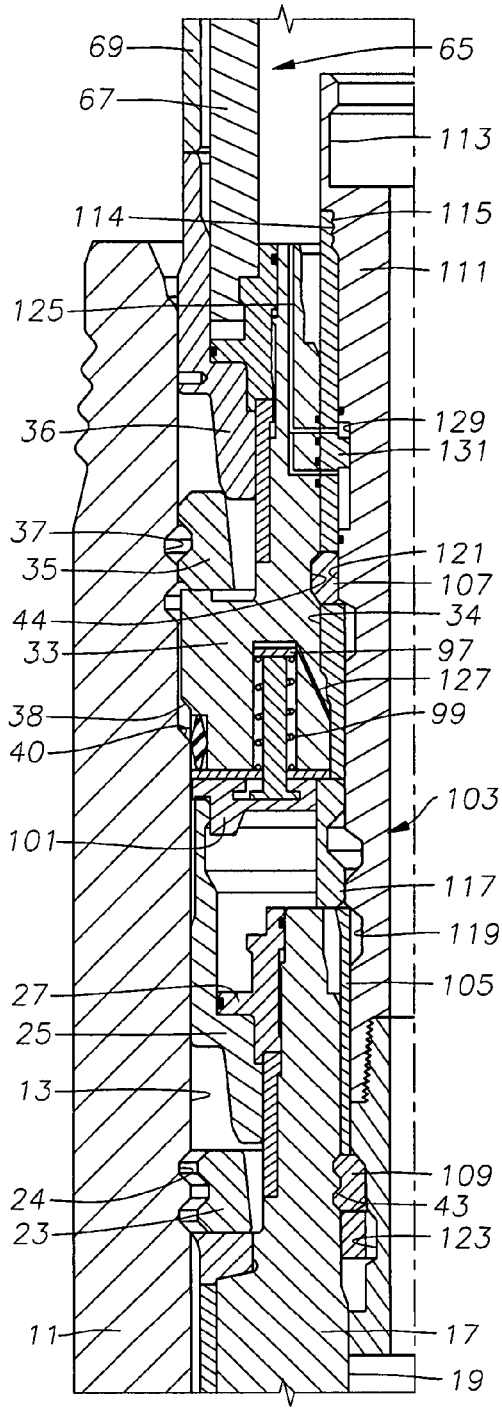
FIG. 12 is another sectional view of the method of FIG. 11 and showing the tubing hanger landed in the tree but not yet locked to the tree.
Figure 13:
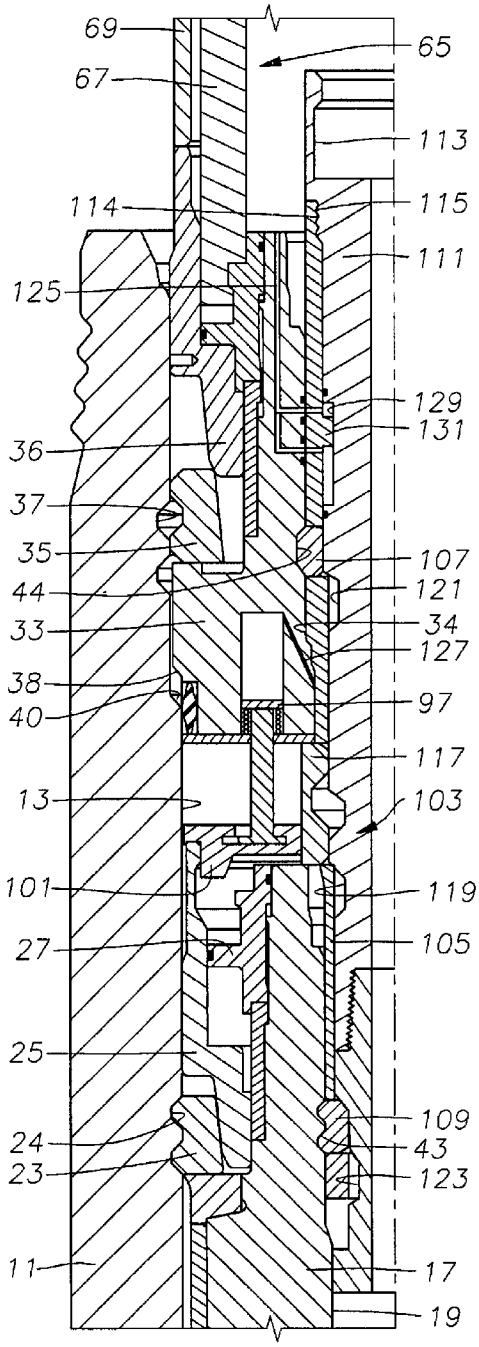
FIG. 13 is another sectional view of the method of FIG. 13 and showing the tubing hanger locked to the tree.
Figure 14:
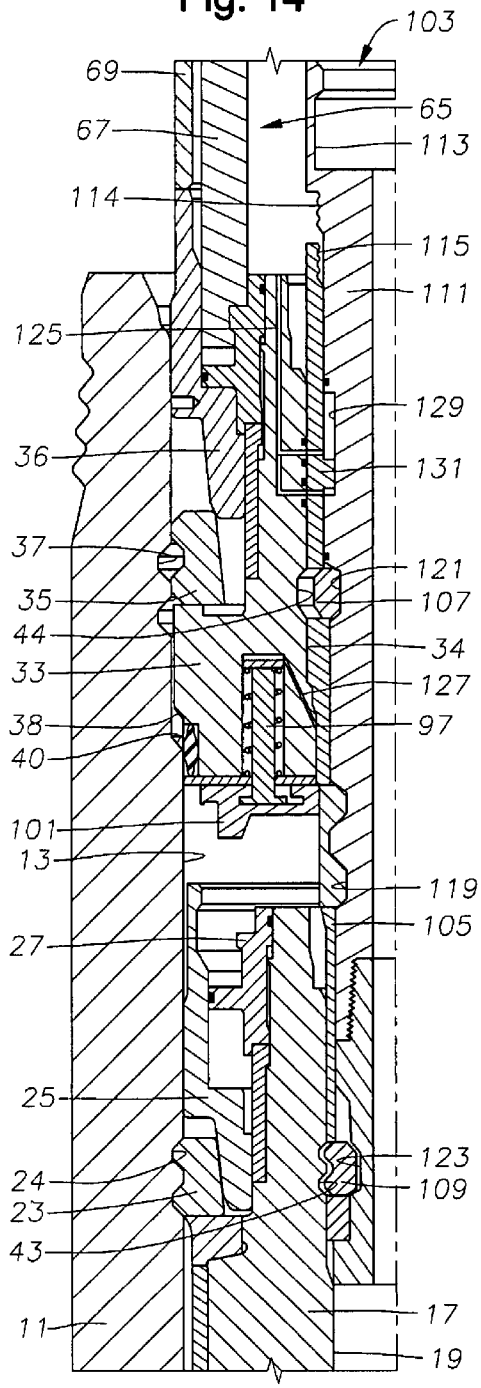
FIG. 14 is another sectional view of the method of FIG. 13 and showing a piston being retracted and a linking assembly of the running tool released from the tubing hanger and internal tree cap for retrieved.

The entire assembly is lowered into the well with the running string. Tubing hanger 33 will land in a position with its locking member 23 aligned with lower profile 24, as shown in FIG. 12. Tree cap locking member 35 will initially be spaced above its profile 37. The operator then supplies hydraulic fluid pressure to piston 97 via running tool 65, causing piston 97 to push tubing hanger actuator 25 downward to the lower locked position shown in FIG. 13. The operator then releases the hydraulic fluid pressure to piston 97 to allow spring 99 to retract piston 97 as shown in FIG. 14. The operator also supplies hydraulic fluid pressure to chamber 129 on the upper side of piston 131 to cause wickers 114, 115 to release to move stem 111 to the upper position shown in FIG. 14. This step frees linking assembly 103 to be retrieved by a wireline tool engaging profile 113. Expansion ring 117 will retract into its profile 119, causing transfer plate 101 to retract. The weight of the running string pushes tree cap 33 downward until its shoulder 38 lands on tree bore shoulder 40, thereby aligned tree cap locking member 35 with tree bore profile 37.

Figure 15:
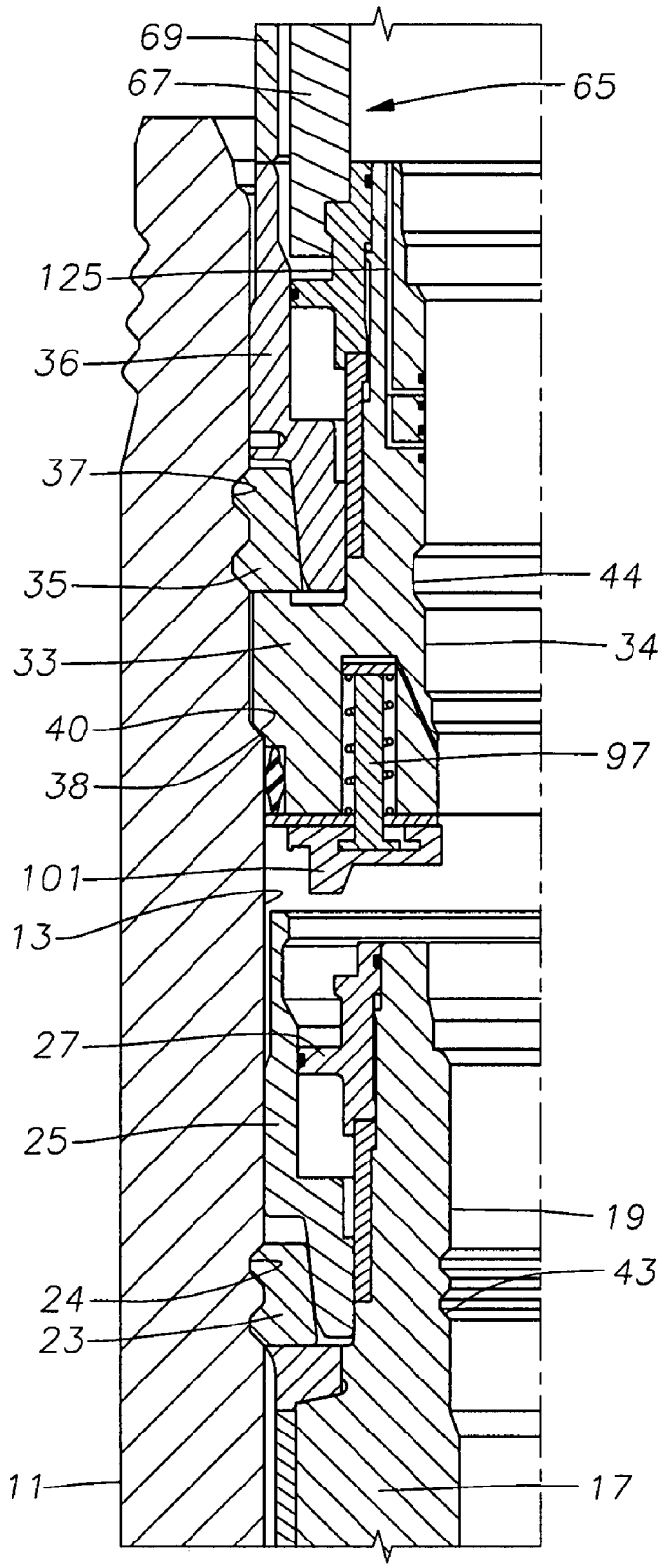
FIG. 15 is another sectional view of the method of FIG. 13 and showing the internal tree cap locked to the tree.

The operator then uses actuating sleeve 67 of running tool 65 to stroke tree cap actuator 36 to the lower locked position of FIG. 15.

Figure 16:
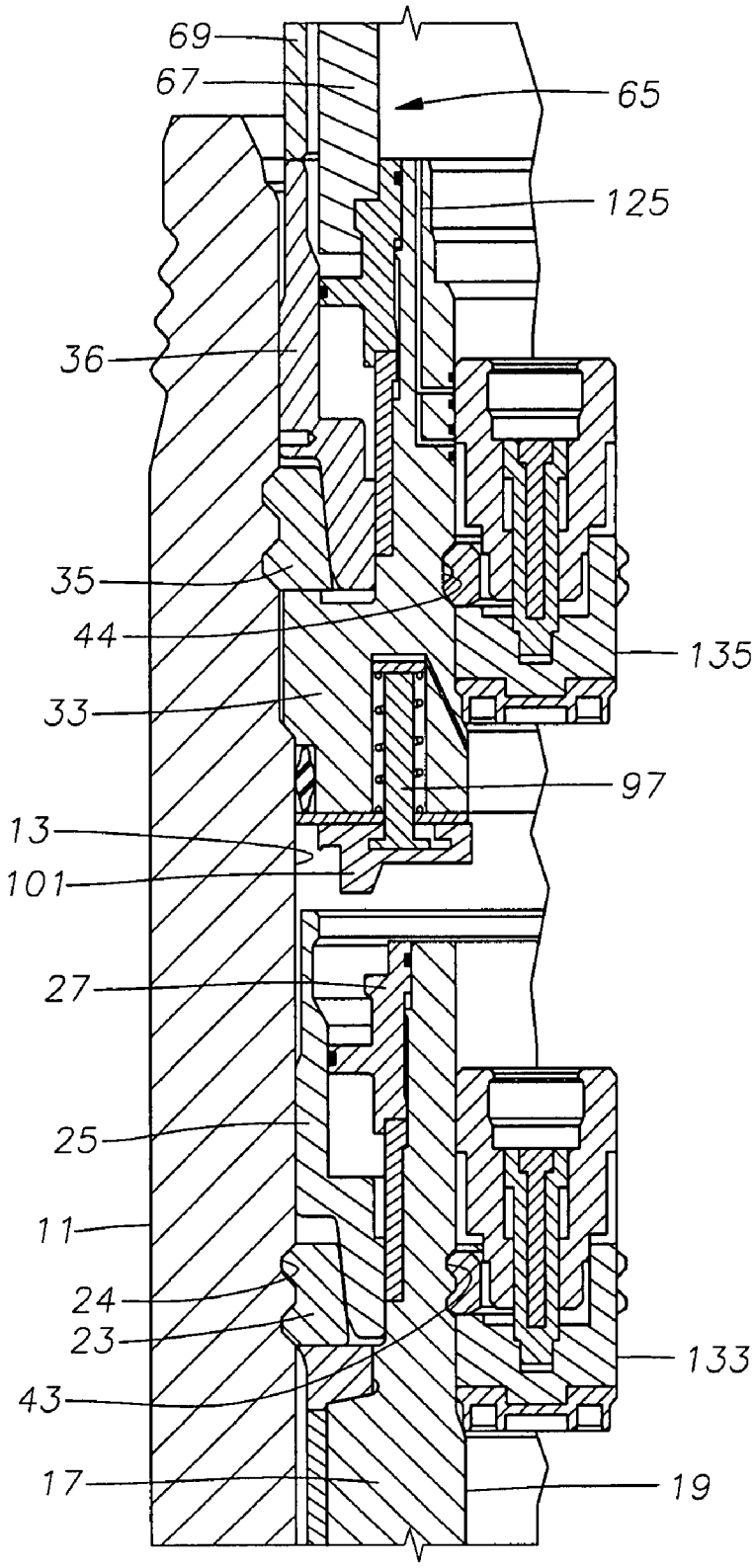
FIG. 16 is another sectional view of the method of FIG. 13 and showing crown plugs installed in the tubing hanger and the internal tree cap.

The operator may optionally detach running tool 65 in the conventional manner and retrieves the running string. Alternately, the operator may choose to install tubing hanger crown plug 133 and internal tree cap crown plug 135 as shown in FIG. 16 before detaching running tool 65. In that instance, crown plugs 133, 135 are lowered separately on wireline tools through the running string and running tool 65 and installed conventionally.

In each of the embodiments, tubing hanger 17 and tree cap 33 can be retrieved simultaneously by reversing the steps described. Alternately, tree cap 33 can be retrieved by a conventional running tool, then tubing hanger 17 retrieved in a separate trip by the same running tool. In each of the embodiments, after tubing hanger 17 and tree cap 33 are locked to tree bore 13 and the running tool assembly removed, tubing hanger 17 and tree cap 33 are free of any engagement with each other.

The invention has significant advantages. By simultaneously running the tree cap and tubing hanger, a separate trip with a drill pipe running string is not required. Omitting a trip can save a considerable amount of time in deep water. This method allows the use of a separate sealing member through an internal tree cap, rather than using two crown plugs within a tubing hanger as in the prior art. The various embodiments allow the tubing hanger and internal tree cap to be retrieved during a workover with a single running string trip.

While the invention has been shown in only a few of its forms, it should be apparent to those skilled in the art that it is not so limited but is susceptible to various changes without departing from the scope of the invention.

We claim:

1. A method of completing a subsea well having a subsea tree having a bore, comprising:

(a) connecting a linking member between the internal tree cap and the tubing hanger;

(b) connecting a running tool to an internal tree cap and to a tubing hanger, then lowering the internal tree cap, tubing hanger and string of tubing as an assembly, and landing the tubing hanger in the bore of the tree; then (c) locking the tubing hanger and the internal tree cap to the bore of the tree, wherein the internal tree cap and the tubing hanger each have a radially movable locking element and an axially movable actuator, and step (c) comprises:

stroking the actuator of the tubing hanger to cause the locking element of the tubing hanger to move radially into a lower profile formed in the bore of the tree; then stroking the actuator of the internal tree cap to cause the locking element of the internal tree cap to move radially into an upper profile formed in the bore of the tree.

2. The method according to claim 1, wherein step (c) comprises:

locking the tubing hanger to the bore of the tree before locking the internal tree cap to the bore of the tree.

3. The method according to claim 1, wherein step (b) comprises:

connecting a lifting device of the running tool to the internal tree cap; and wherein the method further comprises after step (c) retrieving the linking assembly.

4. The method according to claim 1, wherein each of the internal tree cap and the tubing hanger has an axially extending passage, and step (b) comprises:

connecting a lifting device of the running tool to the internal tree cap and connecting a linking assembly between profiles foiined in the bore of the internal tree cap and the tubing hanger so that the internal tree cap supports the weight of the tubing hanger through the linking assembly, and lowering the assembly on a tubular running string; and wherein the method further comprises after step (b) lowering a retrieval tool on a wire through running string and retrieving the linking assembly, then retreiving the running string and the running tool.

5. The method according to claim 1, wherein at the completion of step (c), the internal tree cap and the tubing hanger are free of any engagement with each other.

6. The method according to claim 1, further comprising for a workover operation: connecting a retrieval tool to the internal tree cap and the tubing hanger; then retrieving the retrieval tool, internal tree cap, an string of tubing as an assembly.

7. A method of completing a subsea well having a subsea tree having a bore, comprising:

(a) connecting a linking member between the internal tree cap and the tubing hanger;

(b) connecting a running tool to an internal tree cap and to a tubing hanger, then lowering the internal tree cap, tubing hanger and string of tubing as an assembly, and landing the tubing hanger in the bore of the tree; then (c) locking the tubing hanger and the internal tree cap to the bore of the tree, further comprising:

providing each of the internal tree cap and the tubing hanger with a radially movable locking element and an axially movable actuator;

providing the internal tree cap with an axially movable piston; and step (c) comprises:

after the tubing hanger lands, with the running tool, actuating the piston to push the actuator of the tubing hanger downward to cause the locking element of the tubing hanger to move radially into a lower profile formed in the bore of the tree; then with the running tool, stroking the actuator of the internal tree cap downward to cause the locking element of the internal tree cap to move radially into the upper profile.

8. A method of installing a tubing hanger and an internal tree cap in a subsea tree having a bore with upper and lower profiles formed therein, the method comprising:

(a) connecting a running tool to the internal tree cap and linking the internal tree cap to the tubing hanger with a linking assembly, connecting the running tool to a running string and lowering the internal tree cap, tubing hanger and string of tubing as an assembly, and landing the tubing hanger in the bore of the tree; then stroking the actuator of the tubing hanger to cause the locking element of the tubing hanger to engage the lower profile; then stroking the actuator of the internal tree cap to cause the locking element of the internal tree cap to engage the upper profile; then retrieving the linkage assembly and the running tool.

9. The method according to claim 8, wherein step (d) comprises: retrieving the linkage assembly, then retrieving the running tool.

10. The method according to claim 8, wherein step (d) comprises:

lowering a retrieval tool on a line through the running string, latching into the linkage assembly and retrieving the linkage assembly through the running string; then retrieving the running tool with the running string.

11. The method according to claim 8, wherein step (b) comprises:

after the tubing hanger lands, continuing to lower the internal tree cap to push the actuator of the tubing hanger downward to cause the locking element of the tubing hanger to move radially into the lower profile; and step (c) comprises:

causing the running tool to stroke the actuator of the internal tree cap downward to cause the locking element of the internal tree cap to move radially into the upper profile.

12. A subsea well assembly, comprising:

a subsea tree having a bore with upper and lower profiles;

a tubing hanger having a radially movable locking element and an axially movable actuator for moving the locking element of the tubing hanger into engagement with the lower profile;

an internal tree cap having a radially movable locking element and an axially movable actuator for moving the locking element of the internal tree cap into engagement with the upper profile; and a running tool having a lift member that releasably engages a body portion of the internal tree cap for lowering the tree cap into the bore of the tree, an actuator sleeve that releasably engages the actuator of the internal tree cap to stroke the actuator of the internal tree cap, and a linking assembly that releasably connects the tubing hanger to the internal tree cap so as to transmit the weight of the tubing hanger during running-in to the internal tree cap and to the running tool.

13. The assembly according to claim 12, wherein the actuator of the tubing hanger is moved axially by downward movement of the internal tree cap relative to the tubing hanger after the tubing hanger has landed in the bore of the tree.

14. The assembly according to claim 12, further comprising:

a piston mounted to the internal tree cap in engagement with the actuator of the tubing hanger for moving the actuator of the tubing hanger axially after the tubing hanger has landed in the bore of the tree.

15. The assembly according to claim 12, wherein the linking assembly is separately retrievable from the running tool.

16. The assembly according to claim 12, wherein each of the tubing hanger and the internal tree cap has an axial passage, and wherein the linking assembly engages profiles fowled in the passages of the tubing hanger and the internal tree cap.

17. The assembly according to claim 15, wherein:

the running tool is lowered on a running string; and the linking assembly has an upper end for engagement by a retrieval tool lowered through the running string.

18. The assembly according to claim 14, wherein each of the tubing hanger and the internal tree cap has an axial passage, and wherein the linking assembly engages profiles fowled in the passages of the tubing hanger and the internal tree cap.

19. The assembly according to claim 17, wherein:

the running tool is lowered on a running string; and the linking assembly has an upper end for engagement by a retrieval tool lowered through the running string.

* * * * *